US007176838B1

(12) United States Patent
Kinezos

(10) Patent No.: US 7,176,838 B1
(45) Date of Patent: Feb. 13, 2007

(54) MULTI-BAND ANTENNA

(75) Inventor: Christos L. Kinezos, Sunrise, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 11/208,673

(22) Filed: Aug. 22, 2005

(51) Int. Cl.
*H01Q 1/38* (2006.01)

(52) U.S. Cl. ..... 343/700 MS; 343/729; 343/702; 343/767

(58) Field of Classification Search ..... 343/700 MS, 343/702, 729, 767, 741, 866, 725
See application file for complete search history.

(56) References Cited

U.S. PATENT DOCUMENTS 6,762,723 B2 7/2004 Nallo et al.
6,917,335 B2 * 7/2005 Kadambi et al. .... 343/700 MS
7,095,372 B2 * 8/2006 Soler Castany et al. .... 343/700 MS
7,095,382 B2 * 8/2006 Surducan et al. ..... 343/793
* cited by examiner

*Primary Examiner*—Hoanganh Le

(57) ABSTRACT

A multi-band antenna (10) includes one or more a loop portions (12) substantially defining operation in frequency ranges covering between approximately 800 MegaHertz and approximately 1.0 GigaHertz and between approximately 1.8 GigaHertz and approximately 2.0 GigaHertz, a surface plate portion (14) having a length (15) substantially defining operation in a frequency range between approximately 1.7 GigaHertz and approximately 1.9 GigaHertz, and a slot (16) within the surface plate portion having a length (17) substantially defining operation in a frequency range between 5 and 6 Gigahertz (WLAN). The antenna can further include a resonant stub (18) having a length (19) substantially defining operation in a frequency range of approximately 2.4 Gigahertz. The antenna can be a unitary radiating element having a feed element (9) and a ground port (7). Operationally, the antenna can function in 6 bands and can be independently tunable in a majority of the 6 bands.

20 Claims, 3 Drawing Sheets

MULTI-BAND ANTENNA

FIELD OF THE INVENTION

This invention relates generally to multi-band antennas, and more particularly to a multi-band antenna for use with both cellular and wireless local area network (WLAN) frequencies.

BACKGROUND OF THE INVENTION

Existing Quad-band GSM internal antennas fail to cover the 5 GHz WLAN band or the 2.4 GHz band commonly used for Bluetooth and other short range communication protocols. Furthermore, there are very few handset antennas that offer sufficient bandwidth to cover all three international 5 GHz (5.1–5.8 GHz) standards (IEEE 802.11a (International), ETSI HiperLan2 (Europe) and MMAC HiSWANa (Japan)). Typically, when multiple bands need coverage, a communication product will implement multiple discrete antennas to cover the various different bands.

SUMMARY OF THE INVENTION

Embodiments in accordance with the present invention can provide a multi-band antenna in a new geometry using a single element antenna that covers cellular and WLAN bands such as all 4 GSM bands and the 5 GHz WLAN or the 2.4 GHz band. This antenna embodiment can eliminate the need for multiple antennas in a handset and can further provide multiple bands that can be individually tuned to cover all 4 GSM bands and both WLAN bands (2.4 GHz and 5 GHz). It can also be used in any Quad-band GSM product that requires Bluetooth (2.4 GHz).

In a first embodiment of the present invention, an antenna can include a unitary radiating element further including a loop portion substantially defining operation covering between approximately 800 MegaHertz and approximately 1.0 GigaHertz and between approximately 1.8 GigaHertz and approximately 2.0 GigaHertz, a surface plate portion having a length substantially defining operation in a frequency range covering approximately 1.7 GigaHertz and approximately 1.9 GigaHertz and a slot within the surface plate portion having a length substantially defining operation in a frequency range between approximately 5 and 6 Gigahertz. The unitary radiating element can further include a resonant stub substantially defining operation in a frequency range of approximately 2.4 Gigahertz. The unitary radiating element can further include a feed element and a ground port. The antenna can be made of sheet metal. Operationally, the antenna can function in 6 bands and can be independently tunable in a majority of the 6 bands. For example, the loop portion can define the frequency operation in GSM 850/900 and PCS frequency Bands. When including the resonant stub, the antenna can operate as a quad-band GSM antenna and a dual-band WLAN antenna (5 GHz and 2.4 GHz). Additionally, the antenna can have sufficient bandwidth to operate in all international 5 Gigahertz bands.

In a second embodiment of the present invention, a multi-band antenna can include a single radiating element having a first portion in the form of a loop substantially tunable for frequencies between approximately 800 MegaHertz and approximately 1.0 GigaHertz and between approximately 1.8 GigaHertz and approximately 2.0 GigaHertz such as the GSM850/900 and PCS (1900) frequency bands, a second portion contiguous with the first portion and in the form of a surface plate substantially tunable in the 1.7 GigaHertz to 1.9 GigaHertz range, and a slot in the second portion substantially tunable for a first band such as the 5 GHz to 6 GHz WLAN bands. The single radiating element can further include a third portion contiguous with the first portion and in the form of a tuning stub for substantially tuning a second WLAN band such as the 2.4 GHz WLAN band. The multi-band antenna operates with sufficient spherical or radiation efficiency in the 850, 900, 1800, and 1900 megahertz band ranges, the 2.4 Gigahertz band range, and the 5 Gigahertz band range and can further have sufficient bandwidth to cover all international 5 Gigahertz bandwidths. The total power radiated into space is the accepted power reduced by the effect of conduction loss, which is commonly called radiation efficiency. What sufficient spherical or radiation efficiency can be depends on a particular manufacturer's or customer's requirements. Typically, a minimum of 30% efficiency is acceptable and more than 50% is desired for better performance.

In a third embodiment of the present invention, a wireless communication device can include an antenna having a unitary radiating element. The unitary radiating element can include a loop portion substantially defining operation in a frequency range between frequencies between approximately 800 MegaHertz and approximately 1.0 GigaHertz and between approximately 1.8 GigaHertz and approximately 2.0 GigaHertz, a surface plate portion having a length substantially defining operation in a frequency range between the 1.7 GigaHertz to 1.9 GigaHertz range such as DCS 1800 (1710–1880 MHz), and a slot within the surface plate portion having a length substantially defining operation in a frequency range between 5 and 6 Gigahertz. The unitary radiating element can further include a resonant stub substantially defining operation in a frequency range of approximately 2.4 GHz (covering 802.11b,g standards, for example.)

DETAILED DESCRIPTION OF THE DRAWINGS

Figure 1:
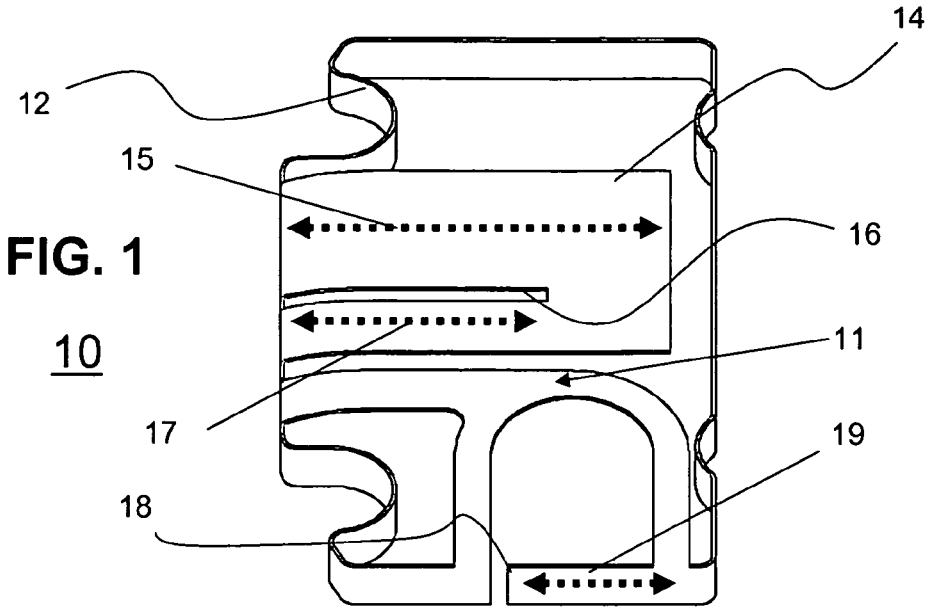
FIG. 1 is a perspective view of a multi-band antenna in accordance with an embodiment of the present invention.

While the specification concludes with claims defining the features of embodiments of the invention that are regarded as novel, it is believed that the invention will be better understood from a consideration of the following description in conjunction with the figures, in which like reference numerals are carried forward.

Currently in the wireless communication industry there is a number of competing communication protocols that utilize different frequency bands. In a particular geographical region there may be more than one communication protocol in use for a given type of communication (e.g., wireless telephones). Examples of communication protocols for wireless telephones include GSM 900, AMPS, GSM 1800, GSM 1900, and UMTS. In addition, certain communication protocols may be exclusive to certain regions. Additionally future communication protocols are expected to utilize different frequency bands. A communication product that accommodates various different frequency bands in the future and still be capable of utilizing a currently used communication protocol naturally has great versatility.

A multi-band antenna in accordance with the embodiments herein can operate using more than one communication protocol and naturally receives and transits signals in different frequency bands. Since wireless communication devices have reduced in size, existing monopole antennas sized to operate at the operating frequency of the communication device are significant in determining the overall size of the communication device. In the interest of user convenience in carrying portable wireless communication devices, it is desirable to reduce the size of the antenna and it is desirable to have an antenna that can be fit within in a device housing in a space efficient manner. In this regard, it is also desirable to have a single antenna capable of operating in multiple frequency bands rather than having separate antenna for the different bands. A single element antenna covering 5 or 6 bands in accordance with some embodiments herein can be referred to as a "single element penta/hexa-band internal antenna" or in other embodiments as a "single element loop PIFA penta/hexa band internal antenna". Notwithstanding these names or labels, the scope of the claims should not be limited to these labels and can certainly include devices that may not necessarily coincide with the scope implied by such names.

Figure 2:
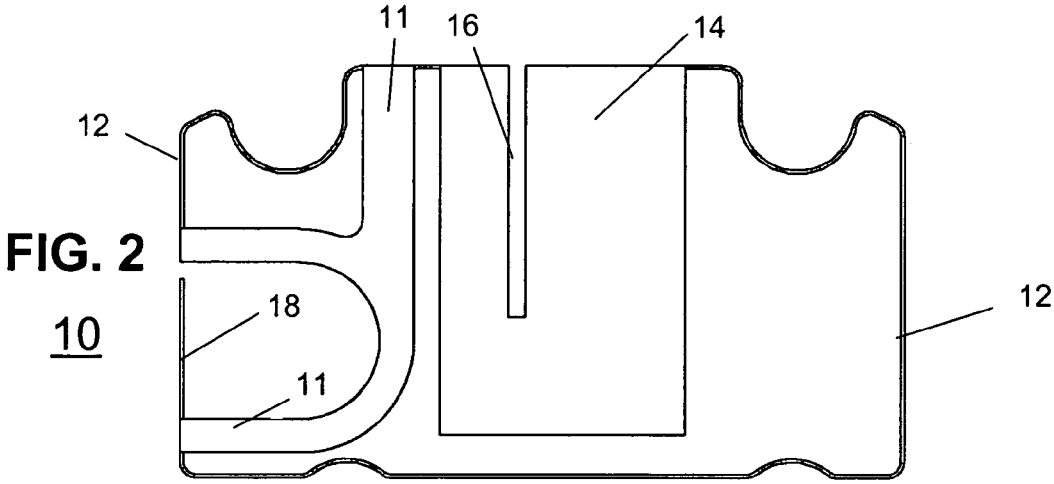
FIG. 2 is a top view of the antenna of FIG. 1 in accordance with an embodiment of the present invention.
Figure 3:
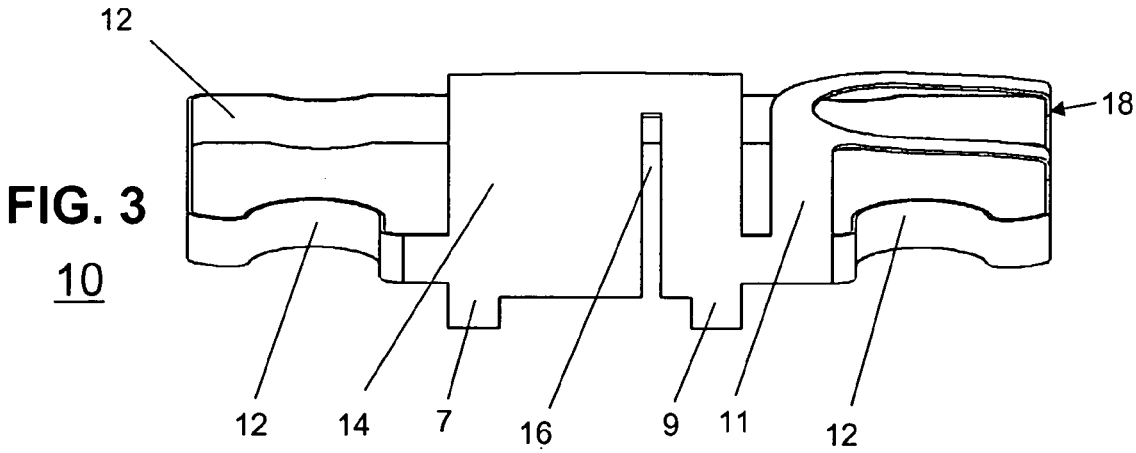
FIG. 3 is left side perspective view of FIG. 1 in accordance with an embodiment of the present invention.

Referring to FIGS. 1–3, a multi-band antenna 10 is shown having a unitary or single radiating element. The antenna 10 can be made of any suitable radiating materials and can be made from sheet metal. The antenna excites various resonant modes (Common modes, Differential modes and Slot mode) that define the frequencies of operation. The antenna 10 can include one or more a loop portions 12 substantially defining operation in frequency ranges covering between approximately 800 MegaHertz and approximately 1.0 GigaHertz and between approximately 1.8 GigaHertz and approximately 2.0 GigaHertz (and more particularly covering GSM 850 (824–894 MHz), GSM 900 (880–960 MHz) and PCS (1850–1990 MHz)), a surface plate portion 14 having a length 15 substantially defining operation in a frequency range between the 1.7 GigaHertz to 1.9 GigaHertz range such as DCS 1800 (1710–1880 MHz), and a slot 16 within the surface plate portion 14 having a length 17 substantially defining operation in a frequency range between 5 and 6 Gigahertz (WLAN). The unitary radiating element (10) can further include a resonant stub 18 having a length 19 substantially defining operation in another WLAN frequency range substantially covering 802.11b, g (2.412–2.484 GHz). The unitary radiating element can further include a feed element 9 and a ground port 7. Operationally, the antenna can function in 6 bands and can be independently tunable in a majority of the 6 bands. For example, the loop portion 12 defines the frequency operation in GSM 850/900 (824.20–959.80 MHz) and PCS 1900 (1850.20–1989.80 MHz) bands. When including the resonant stub 18, the antenna can operate as a quad-band GSM antenna and a dual-band WLAN antenna (5 GHz and 2.4 GHz). Additionally, the antenna can have sufficient bandwidth to operate in all international 5 Gigahertz bands. Note, in this embodiment, the loop portion 12 includes a bypass portion 11 in order to provide for the resonant stub 18.

The antenna 10 not only covers all 4 GSM bands (850 MHz, 900 MHz, 1800 MHz, 1900 MHz) and both WLAN bands (2.4 GHz and 5 GHz), but it covers such bands with sufficient spherical efficiency to meet all required customer radiation requirements for US and Europe.

Figure 4:
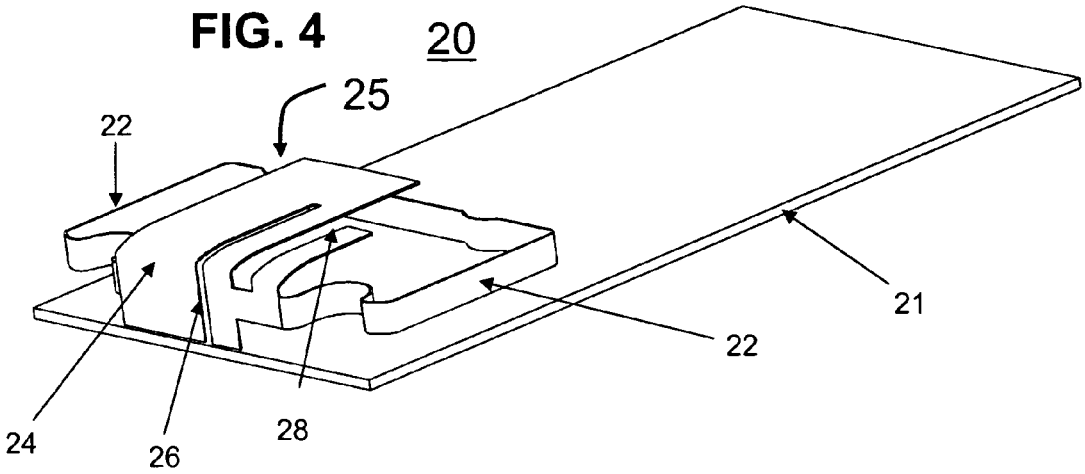
FIG. 4 is a perspective view of a communication device using a multi-band antenna in accordance with an embodiment of the present invention.

Likewise, referring to the wireless communication device 20 shown in FIG. 4, communication device 20 includes a compact single element multi-band internal antenna 25 that also covers all 4 GSM bands (850 MHz, 900 MHz, 1800 MHz, 1900 MHz) and both 5 GHz WLAN bands (5.2 GHz (USA), 5.8 GHZ (Europe)) with sufficient spherical efficiency to meet all required internal and customer radiation requirements for US and Europe. The geometry of the antenna 25 and placement is configured for a monolith radio mounted on a printed circuit board 21 but is certainly not limited to such configuration. The antenna 25 can include a loop portion 22, a sheet metal top plate portion 24, and a slot 26 within the top plate portion 24. The antenna 25 includes a tuning stub 28. Note, this embodiment does not include a loop bypass element as found in antenna 10.

Figure 5:
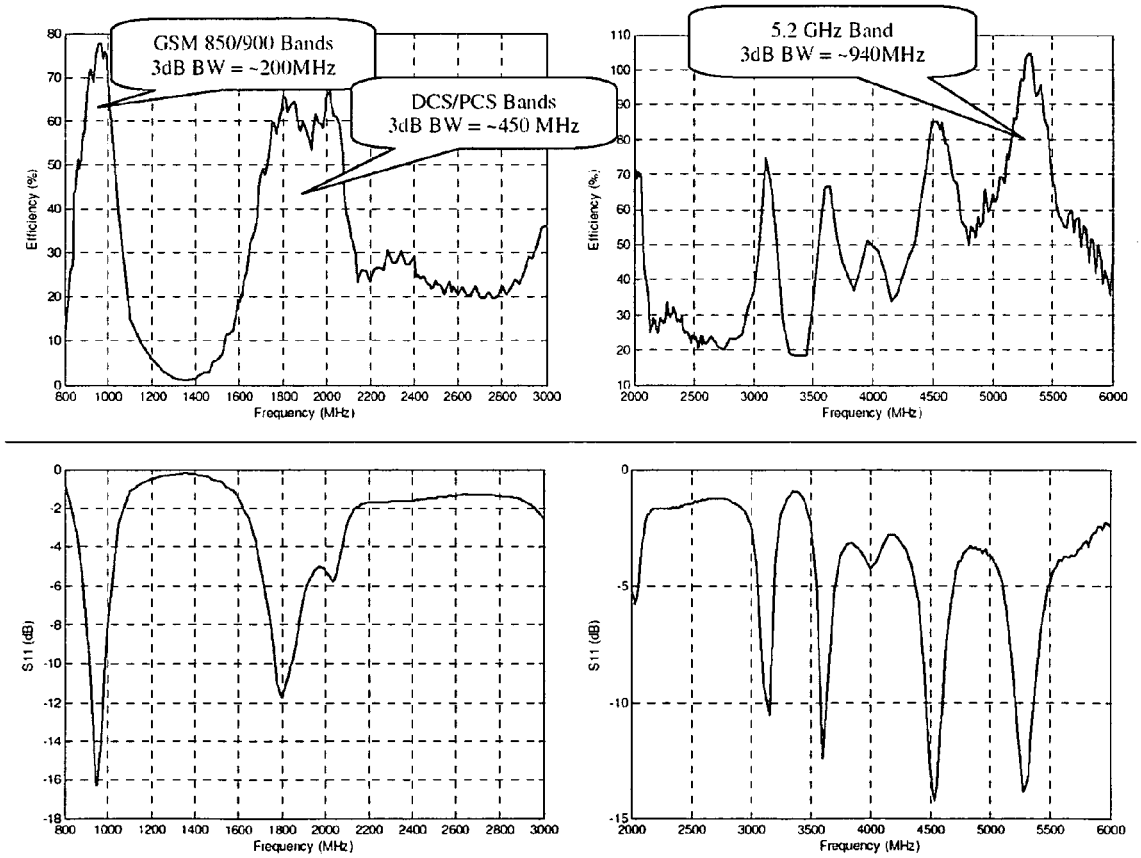
FIG. 5 includes charts illustrating measured free-field spherical efficiency for the multi-band antenna of FIG. 4 in accordance with an embodiment of the present invention.
Figure 6:
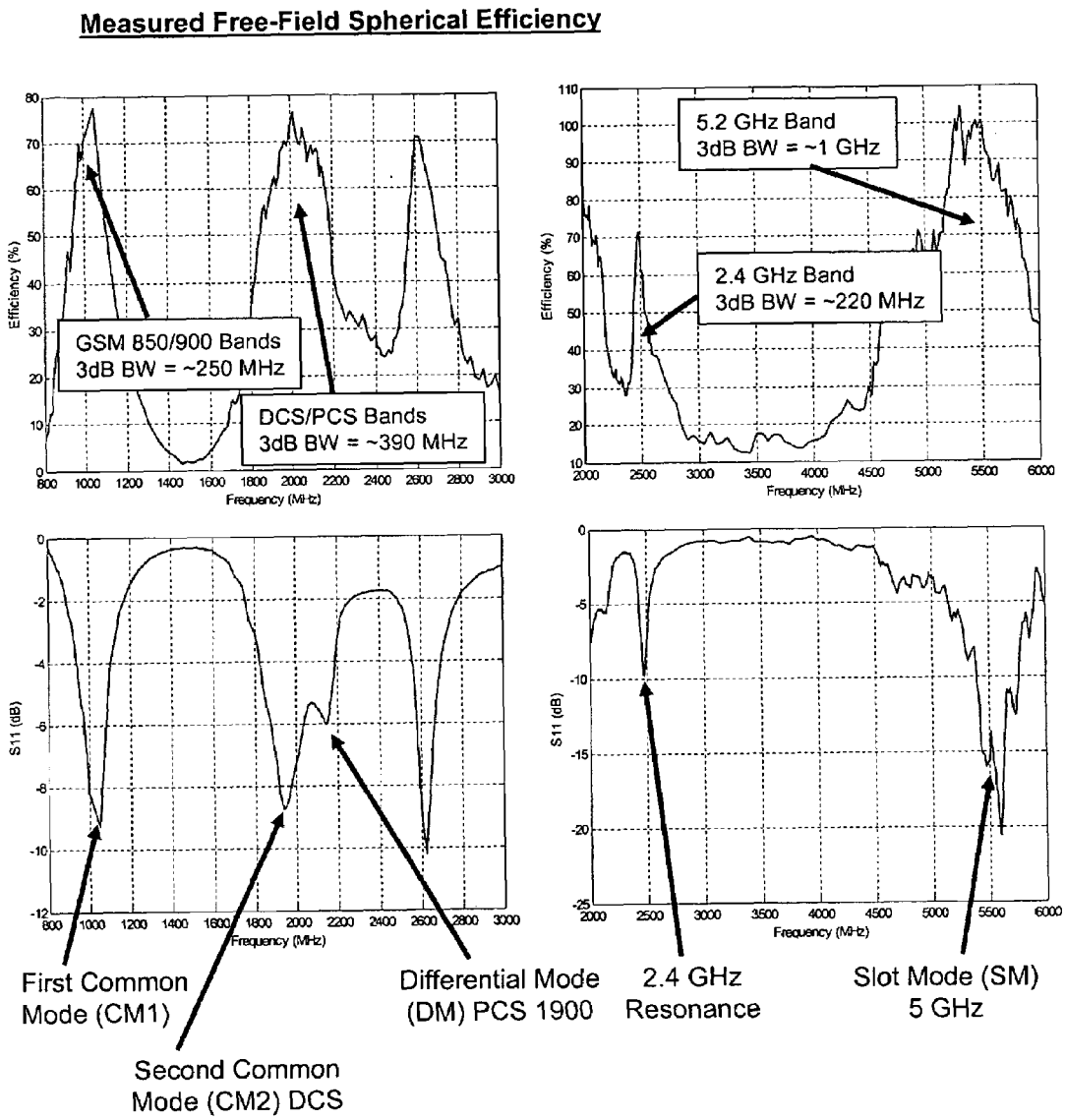
FIG. 6 includes charts illustrating measured free-field spherical efficiency for the multi-band (6 band) antenna of FIGS. 1–3 in accordance with an embodiment of the present invention.

The measured Free-Field spherical efficiency of antenna 25 of FIG. 4 is illustrated in FIG. 5. The antenna 25 provides a maximum of 78% of free-field efficiency with about 200 MHz of 3 dB bandwidth at the GSM 850/900 MHz bands. The efficiency of antenna 25 at DCS/PCS (1.8/1.9 GHz) bands is about 65% with about 450 MHz of 3-dB bandwidth. The 5 GHz resonance provides enough of a broadband response to more than cover the 5.2 GHz US WLAN band. A similar graph for antenna 10 illustrated in FIG. 6 illustrates that the 5 GHz resonance provides enough bandwidth (3-dB BW=~1 GHz) to cover three international 5 GHz WLAN transmission standards (IEEE 802.11a (International), ETSI HiperLan2 (Europe) and MMAC HiSWANa (Japan)). The graph of FIG. 6 further shows the additional 2.4 GHz resonance which covers the frequency region covering the 802.11b, g protocols. Most WLAN handset antennas cover only a part of the 5 GHz spectrum. This wide bandwidth in the 5 GHz spectrum makes multi-band antenna 10 favorable to WLAN cell-phone manufacturers because the same product can be marketed to any country towards any WLAN standard either if it is 2.4 GHz or any of the 5 GHz bands.

With respect to antenna 10 of FIGS. 1–3, the antenna 10 generates various radiation mechanisms including a two common modes, a differential mode, and a slot mode.

The first resonant mode covering both 850/900 GSM bands, referenced as Common Mode (CM1) in actual tests of antenna 10 demonstrated a high current distribution at the side of the feed-point 9 and high E-Field at the other side. This radiation mechanism is similar to the radiation mechanism of a folded dipole antenna. The prototype constructed measured about 200 MHz of 3-dB bandwidth providing about 78% Free-Field efficiency. The frequency response of this mode is essentially controlled by the length of the loop and the dielectric material used to support the antenna.

The second resonant mode covers the DCS band. It comes from the top surface layer (14) of the antenna 10. Similarly as in the CM1 resonance, the current distribution is high at the side of the feed 9 and at the edges of the antenna and the E-Field is maximum at the front edge of the antenna similarly as a conventional PIFA would resonate.

The third resonant mode or differential mode (DM) generated by the loop-like element is observed at PCS frequency. The E-Field at the two sides of the antenna is in 180 degrees out of phase creating a differential mode resonance. This resonance can be tuned to be very close to the Second resonant Mode to create a broadband response that covers both DCS and PCS bands.

The last resonance of this antenna (5 GHz) or slot mode (SM) has enough bandwidth to cover three international 5 GHz WLAN transmission standards (IEEE 802.11a (International), ETSI HiperLan2 (Europe) and MMAC HiSWANa (Japan)). The current distribution and E-Field have emphasis in and around the slot 16. The tuning of this band depends on the length of the slot ($\lambda/4$) and the dielectric material used to support the antenna.

Antenna 10 (as well as 25) is for the most part independently tunable of the individual resonances. As described previously, the resonances of the antenna are produced from different sections and such configuration makes it extremely simple to tune the antenna to an individual resonance without affecting the others. The only resonances that are produced from the same section (the loop portion) of the antenna are CM1 (λ/2) and DM (λ). Those resonances cover the GSM 850/900 (824 MHz–959 MHz) and DCS 1800 (1710–1879) bands which are conveniently double to each other. Therefore, by tuning one band in frequency, at the same time the other band is tuned at the second band as well. The CM2 resonance, as is explained previously is produced from the surface element 14 (PIFA-like) on top of the antenna. The independent tunability of this resonance depends on the length 15 of the top surface element 14 which can be varied. The 2.4 GHz resonance is controlled by the resonant stub 18 located at the side of the antenna 10. A return loss measurement (S11) graph generated empirically by varying the length of the stub (not included herein) demonstrates that this antenna can be independently tuned by varying the length 19 of the stub 18 without affecting the response of the antenna at the other resonances. In similar manner, the tunability of the 5 GHz resonance (SM) has no effect on the rest of the response of the antenna since the currents on this resonance are essentially confined in the slot.

In light of the foregoing description, it should also be recognized that embodiments in accordance with the present invention can be realized in numerous configurations contemplated to be within the scope and spirit of the claims. Additionally, the description above is intended by way of example only and is not intended to limit the present invention in any way, except as set forth in the following claims.

What is claimed is:

1. An antenna, comprising:

a unitary radiating element further comprising:

a loop portion substantially defining operation in frequency ranges between approximately 800 MegaHertz and approximately 1 GigaHertz and between approximately 1.8 GigaHertz and approximately 2.0 GigaHertz;

a surface plate portion having a length substantially defining operation in a frequency range between approximately 1.7 GigaHertz and approximately 1.9 GigaHertz; and a slot within the surface plate portion having a length substantially defining operation in a frequency range between approximately 5 and 6 Gigahertz.

2. The antenna of claim 1, wherein the unitary radiating element further comprises a resonant stub substantially defining operation in a frequency range of approximately 2.4 Gigahertz.

3. The antenna of claim 1, wherein the unitary radiating element further comprises a feed element.

4. The antenna of claim 1, wherein the unitary radiating element further comprises a ground port.

5. The antenna of claim 1, wherein the antenna comprises sheet metal.

6. The antenna of claim 1, wherein the antenna operates in 6 bands and is independently tunable in a majority of the 6 bands.

7. The antenna of claim 1, wherein the loop portion defines the frequency operation in all GSM bands.

8. The antenna of claim 2, wherein the antenna is a quad-band GSM antenna and a dual-band WLAN antenna.

9. The antenna of claim 1, wherein the antenna has sufficient bandwidth to operate in all international 5 Gigahertz bands.

10. A multi-band antenna, comprising:

a single radiating element having:

a first portion in the form of a loop substantially tunable in frequency ranges covering between approximately 800 MegaHertz and approximately 1 GigaHertz and between approximately 1.8 GigaHertz and approximately 2.0 GigaHertz;

a second portion contiguous with the first portion and in the form of a surface plate substantially tunable in frequency ranges between approximately 1.7 GigaHertz and approximately 1.9 GigaHertz; and a slot in the second portion tunable for a first WLAN band.

11. The multi-band antenna of claim 10, wherein the single radiating element further comprises a third portion contiguous with the first portion and in the form of a tuning stub for tuning a second WLAN band.

12. The multi-band antenna of claim 10, wherein the multi-band antenna operates with spherical efficiency in the 850, 900, 1800, and 1900 megahertz GSM band ranges, the 2.4 Gigahertz band range, and the 5 Gigahertz band range.

13. The multi-band antenna of claim 10, wherein the multi-band antenna provides sufficient bandwidth to cover all international 5 Gigahertz bandwidths.

14. A wireless communication device, comprising:

an antenna, comprising:

a unitary radiating element further comprising:

a loop portion substantially defining operation in frequency ranges between approximately 800 MegaHertz and approximately 1 GigaHertz and between approximately 1.8 GigaHertz and approximately 2.0 GigaHertz;

a surface plate portion having a length substantially defining operation in a frequency range between approximately 1.7 GigaHertz and approximately 1.9 GigaHertz; and a slot within the surface plate portion having a length substantially defining operation in a frequency range between 5 and 6 Gigahertz.

15. The wireless communication device of claim 14, wherein the unitary radiating element further comprises a resonant stub substantially defining operation in a frequency range of approximately 2.4 Gigahertz.

16. The wireless communication device of claim 14, wherein the unitary radiating element further comprises a feed element and a ground element coupled to a transceiver.

17. The wireless communication device of claim 14, wherein the antenna operates in 6 bands and is independently tunable in a majority of the 6 bands.

18. The wireless communication device of claim 14, wherein the antenna provides sufficient bandwidth to cover all international 5 Gigahertz bandwidths.

19. The wireless communication device of claim 14, wherein the loop portion substantially defines operation in frequency ranges covering GSM 850 (824–894 MHz), GSM 900 (880–960 MHz) and PCS (1850–1990 MHz).

20. The wireless communication device of claim 14, wherein the length of the surface plate portion substantially defines operation in the DCS 1800 range (1710–1880 MHz).

* * * * *